US012123295B2

(12) United States Patent
Wu et al.

(10) Patent No.: US 12,123,295 B2
(45) Date of Patent: Oct. 22, 2024

(54) SLIDE-ROTATE RATIO MODE OPTIMIZATION FOR MUD MOTOR TRAJECTORY CONTROL

(71) Applicant: HALLIBURTON ENERGY SERVICES, INC., Houston, TX (US)

(72) Inventors: Jian Wu, Houston, TX (US); Robert P. Darbe, Tomball, TX (US); Nazli Demirer, Tomball, TX (US); Vy Pho, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 351 days.

(21) Appl. No.: 17/692,962

(22) Filed: Mar. 11, 2022

(65) Prior Publication Data

US 2022/0372861 A1 Nov. 24, 2022

Related U.S. Application Data

(60) Provisional application No. 63/185,603, filed on May 7, 2021.

(51) Int. Cl.

| | |
|---|---|
| ***E21B 44/00*** | (2006.01) |
| ***E21B 4/02*** | (2006.01) |
| ***E21B 7/06*** | (2006.01) |

(52) U.S. Cl.

CPC ..... *E21B 44/005* (2013.01); *E21B 4/02* (2013.01); *E21B 7/06* (2013.01); *E21B 2200/20* (2020.05)

(58) Field of Classification Search

CPC . E21B 44/005; E21B 4/02; E21B 7/06; E21B 2200/20

See application file for complete search history.

(56) References Cited

U.S. PATENT DOCUMENTS

2003/0010534 A1* 1/2003 Chen ..... E21B 7/068 175/75
2010/0089586 A1* 4/2010 Stanecki ..... E21B 43/2401 166/302

(Continued)

FOREIGN PATENT DOCUMENTS

CA 3013281 A1 * 10/2011 ..... E21B 21/01
CA 2877793 C * 4/2018 ..... E21B 44/00

(Continued)

OTHER PUBLICATIONS

Demirer et al., "Automated Steering with Real-time Model-based Control", 2020, International Petroleum Technology Conference. (Year: 2020).*

(Continued)

*Primary Examiner* — Mohammad Ali
*Assistant Examiner* — Kelvin Booker
(74) *Attorney, Agent, or Firm* — NOVAK DRUCE CARROLL LLP

(57) ABSTRACT

Aspects of the subject technology relate to systems and methods for improving mud motor trajectory controls. Systems and methods are provided for receiving control data from a mud motor trajectory controller, predefining a plurality of control modes based on the control data from the mud motor trajectory controller, achieving desired slide rotate ratios and toolface angles by solving an established objective function that mathematically represents operational preferences and system constraints for a selected control mode of the plurality of control modes, generating a modulation procedure that converts the slide-rotate ratios to a binary slide and rotate control sequence, and applying the modulation procedure to generate the binary slide and rotate control sequence.

20 Claims, 10 Drawing Sheets

(56) References Cited

U.S. PATENT DOCUMENTS

| | | | | |
|---|---|---|---|---|
| 2012/0024606 | A1 | 2/2012 | Pirovolou et al. | |
| 2013/0319764 | A1* | 12/2013 | Schaaf | E21B 7/068 175/50 |
| 2014/0291023 | A1* | 10/2014 | Edbury | E21B 21/08 345/440.2 |
| 2015/0107899 | A1* | 4/2015 | Fisher, Jr. | E21B 44/005 73/152.48 |
| 2015/0233229 | A1* | 8/2015 | Benson | E21B 47/18 700/275 |
| 2015/0377003 | A1* | 12/2015 | Benson | E21B 7/04 175/45 |
| 2016/0369621 | A1* | 12/2016 | Salminen | E21B 7/28 |
| 2017/0058656 | A1* | 3/2017 | Benson | E21B 44/02 |
| 2017/0306702 | A1* | 10/2017 | Summers | E21B 7/10 |
| 2019/0048707 | A1* | 2/2019 | Benson | E21B 7/04 |
| 2020/0063546 | A1* | 2/2020 | Weideman | E21B 7/061 |
| 2020/0165913 | A1 | 5/2020 | Benson et al. | |
| 2020/0370409 | A1 | 11/2020 | Yu et al. | |
| 2021/0140239 | A1* | 5/2021 | Miess | E21B 4/02 |
| 2023/0175383 | A1* | 6/2023 | Pho | G06N 5/01 175/57 |

FOREIGN PATENT DOCUMENTS

| | | | | |
|---|---|---|---|---|
| CA | 3118654 | A1 * | 7/2019 | E21B 19/008 |
| CA | 3040326 | A1 * | 10/2019 | E21B 4/02 |
| CA | 2964639 | C * | 9/2023 | E21B 44/00 |
| EP | 3099883 | A2 * | 12/2016 | E21B 44/04 |
| WO | 2016032640 | A1 | 3/2016 | |
| WO | 2021040786 | A1 | 3/2021 | |

OTHER PUBLICATIONS

Wu et al., "Robust adaptive sliding-mode control of condenser-cleaning mobile manipulator using fuzzy wavelet neural network", Jul. 2013, Fuzzy Sets and Systems 235 (2014) 62-82. (Year: 2013).*

Demirer et al., "Autonomous Directional Drilling with Rotary Steerable Systems", Jul. 2019, 2019 American Control Conference (ACC). (Year: 2019).*

Zhao et al., "Model Predictive Control for Mud Motor Operation in Directional Drilling", Jul. 2019, 2019 American Control Conference (ACC). (Year: 2019).*

Zaliuhoglou et al., "Steering Advisory System for Mud Motors", 2019, SPE/IADC International Drilling Conference and Exhibition. (Year: 2019).*

Zhong et al., "Machine learning for drilling applications: A review", Jun. 2022, Journal of Natural Gas Science and Engineering 108 (2022) 104807 (Year: 2022).*

Majeed, G.A., "Directional Drilling Optimization with Mud Motor and Rotary Steerable System", Nov. 2020, Politecnico Di Torino, Department of Environment, Land and Infrastructure Engineering Master of Science in Petroleum Engineering. (Year: 2020).*

Zhao et al., "Model Predictive Control for Mud Motor Operation in Directional Drilling", Jul. 2019, 2019 American Control Conference (ACC), Philadelphia, PA, USA, Jul. 10-12, 2019. (Year: 2019).*

Zalluhoglu, Umut et al. "Steering Advisory System for Mud Motors." Paper presented at the SPE/IADC International Drilling Conference and Exhibition, The Hague, The Netherlands, Mar. 2019. doi: https://doi.org/10.2118/194077-MS.

Zhao, Yiming et al. "Model Predictive Control for Mud Motor Operation in Directional Drilling." 2019 American Control Conference (ACC) (2019): 5197-5202.

International Search Report & Written Opinion; PCT Application No. PCT/US2022/020380; mailed Jun. 27, 2022.

* cited by examiner

SLIDE-ROTATE RATIO MODE OPTIMIZATION FOR MUD MOTOR TRAJECTORY CONTROL

CROSS-REFERENCE TO RELATED APPLICATIONS

This application claims priority to U.S. provisional application No. 63/185,603 filed on May 7, 2021 which is expressly incorporated by reference herein in its entirety.

TECHNICAL FIELD

The present technology pertains to optimizing drilling processes, and more particularly, to optimizing mud motor trajectory controls.

BACKGROUND

The ever-increasing global demand for hydrocarbon has brought new challenges in drilling through offshore and shale reservoirs. Directional drilling includes drilling wells at multiple angles, not only vertically but also horizontally, to better reach and produce oil and gas reserves. A mud motor is an example of a directional drilling tool used on oil/gas rigs that can convert mud flow (e.g., hydraulic energy) into drilling bit rotation (e.g., mechanical energy).

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
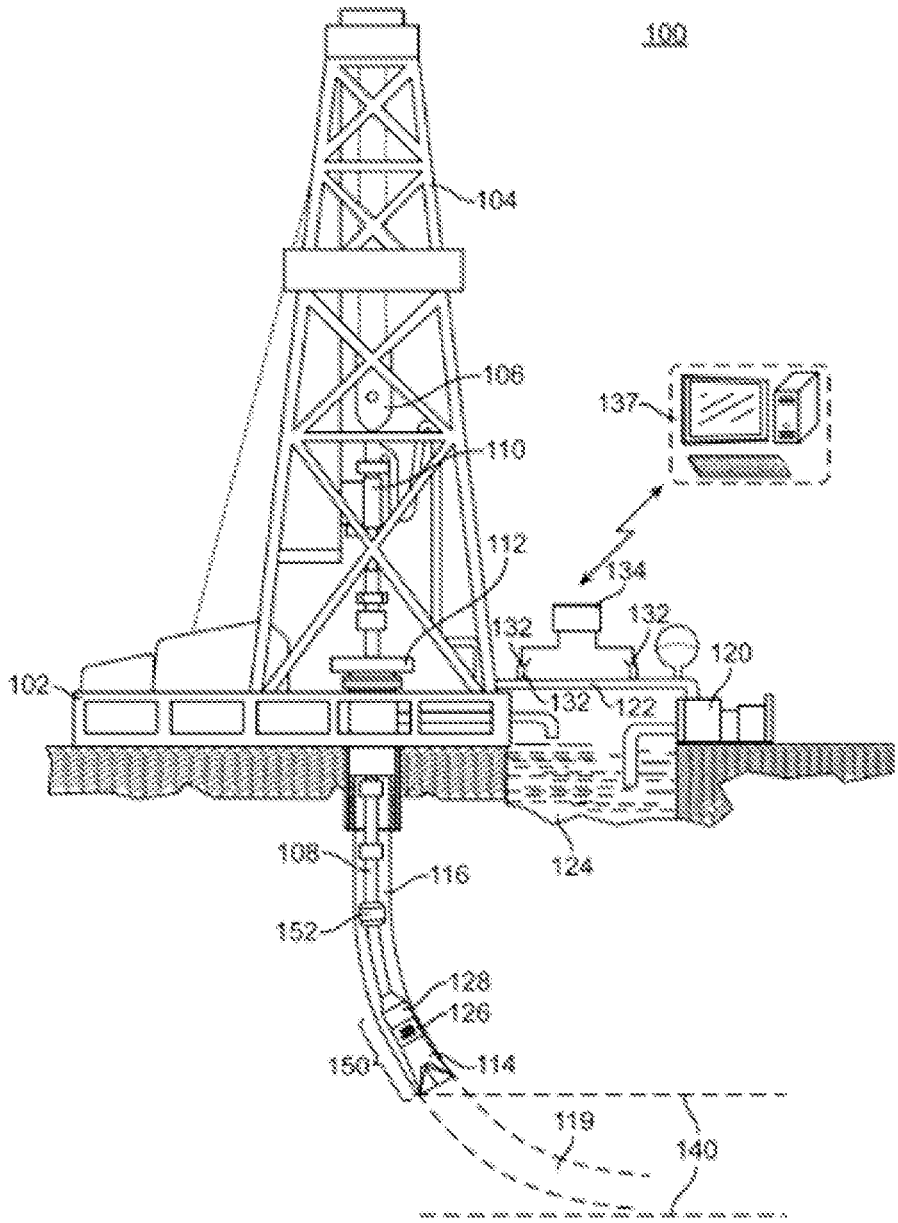
FIG. 1 is a schematic diagram of a directional drilling environment, in which the presently disclosed techniques may be deployed, in accordance with aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The present disclosure includes a method to systematically generate mud motor slide-rotate command sequences that can follow desired curvature demands, while satisfying system constraints such as minimum/maximum continuous slide lengths, minimum rotate lengths, and maximum switching times of slide-rotate allowed for a stand. Oftentimes, during a drilling operation, the drilling personnel's preferences for these constraints may change in order to adapt to formation variations, drilling conditions, and/or safety concerns. Sometimes, longer slides may be preferred to achieve satisfying inclinations during a curve section, or to catch up with the well plan when falling behind. Moreover, a shorter slide may be desired to avoid the risk of stuck pipe, which may lead to switching frequently between a slide and a rotate procedure.

Currently, a slide having a long length would be generally offered to follow curvature demands from the trajectory controller. However, there is a lack of systematic means to address these changes (e.g., system constraints), while maintaining the curvature demands from the trajectory controller.

The disclosed technology addresses the foregoing by providing to fill a blank and to realize mud motor slide rotate command sequence optimization by tracking desired curvature demands generated by the mud motor trajectory controller. The disclosed technology not only provides flexibility for mud motor operations, but also maintains trajectory control performance.

In some implementations, the disclosed technology can also include obtaining control outputs of a mud motor trajectory controller, such as a model predictive control system. The control outputs of the mud motor trajectory controller can include desired curvature demands for oncoming, hundreds of feet to drill. The disclosed technology can further include predefining a finite number of control modes with different settings of maximum/minimum continuous slide and minimum continuous rotate lengths, which can represent different preferences of the slide-rotate operation. Furthermore, the disclosed technology can include generating an objective function in which the obtained trajectory control outputs can be used as reference points. Determining the objective function with the selected control mode can provide the satisfaction of the constraints, including a maximum number of slides for a stand and the corresponding maximum/minimum continuous slide and rotate lengths. In some examples, the resulting ratios and toolface angles can be passed to a post-processing module, where a modulation procedure can be conducted to generate a binary slide rotate command sequence that can be used by an advisory display or an automatic closed loop trajectory control system.

In other implementations, the disclosed technology provides a method of systematically generating slide-rotate command sequences that satisfy system constraints and operational preferences of drilling personnel, while maintaining mud motor trajectory control performance. In some examples, the method further includes predefining a finite number of control modes, establishing and determining an objective function to achieve desired slide-rotate ratios and toolface angles, and developing a modulation procedure to convert decimal ratios to a binary slide-rotate control sequence.

The disclosed technology not only provides the flexibility to operate a mud motor for drilling personnel, but also provides that trajectory control demands be well executed. Simulation results, as shown in FIGS. 6A-E and FIGS. 7A-E, demonstrate its effectiveness. As described herein, the added flexibility and enhanced performance can further improve steering automation products.

The disclosed technology provides for optimizing mud motor trajectory controls. Optimizing, as used herein, includes modifying processes for controlling directional drilling according to the technology described herein. Specifically, optimizing, as used herein, includes generating a slide/rotate command sequence according to defined finite control modes in comparison to typical control techniques, e.g. ones that do not rely on defined finite control modes.

In various embodiments, a method for improving mud motor trajectory controls can include receiving control data from a mud motor trajectory controller. The method can further include predefining a plurality of control modes based on the control data from the mud motor trajectory controller. The method can also include achieving desired slide rotate ratios and toolface angles by solving an established objective function that mathematically represents operational preferences and system constraints for a selected control mode of the plurality of control modes. The method can include generating a modulation procedure that converts the slide-rotate ratios to a binary slide and rotate control sequence. Further, the method can include applying the modulation procedure to generate the binary slide and rotate control sequence.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a schematic diagram of a directional drilling environment, particularly showing a measurement-while-drilling (MWD) system 100, in which the presently disclosed techniques may be deployed. As depicted, the MWD system 100 includes a drilling platform 102 having a derrick 104 and a hoist 106 to raise and lower a drill string 108. Hoist 106 suspends a top drive 110 suitable for rotating drill string 108 and lowering drill string 108 through a well head 112. Notably, drill string 108 may include sensors or other instrumentation for detecting and logging nearby characteristics and conditions of the wellbore and surrounding earth formation.

In operation, top drive 110 supports and rotates drill string 108 as it is lowered through well head 112. In this fashion, drill string 108 (and/or a downhole motor) rotate a drill bill 114 coupled with a lower end of drill string 108 to create a borehole 116 through various formations. A pump 120 can circulate drilling fluid through a supply pipe 122 to top drive 110, down through an interior of drill string 108, through orifices in drill bit 114, back to the surface via an annulus around drill string 108, and into a retention pit 124. The drilling fluid can transport cuttings from wellbore 116 into pit 124 and helps maintain wellbore integrity. Various materials can be used for drilling fluid, including oil-based fluids and water-based fluids.

As shown, drill bit 114 forms part of a bottom hole assembly 150, which further includes drill collars (e.g., thick-walled steel pipe) that provide weight and rigidity to aid drilling processes. Detection tools 126 and a telemetry sub 128 are coupled to or integrated with one or more drilling collars.

Detection tools 126 may gather MWD survey data or other data and may include various types of electronic sensors, transmitters, receivers, hardware, software, and/or additional interface circuitry for generating, transmitting, and detecting signals (e.g., sonic waves, etc.), storing information (e.g., log data), communicating with additional equipment (e.g., surface equipment, processors, memory, clocks input/output circuitry, etc.), and the like. In particular, detection tools 126 can measure data such as position, orientation, weight-on-bit, strains, movements, borehole diameter, resistivity, drilling tool orientation, which may be specified in terms of a tool face angle (rotational orientation), and inclination angle (the slope), and compass direction, each of which can be derived from measurements by sensors (e.g., magnetometers, inclinometers, and/or accelerometers, though other sensor types such as gyroscopes, etc.).

Telemetry sub 128 communicates with detection tools 126 and transmits telemetry data to surface equipment (e.g., via mud pulse telemetry). For example, telemetry sub 128 can include a transmitter to modulate resistance of drilling fluid flow thereby generating pressure pulses that propagate along the fluid stream at the speed of sound to the surface. One or more pressure transducers 132 operatively convert the pressure pulses into electrical signal(s) for a signal digitizer 134. It is appreciated other forms of telemetry such as acoustic, electromagnetic, telemetry via wired drill pipe, and the like may also be used to communicate signals between downhole drilling tools and signal digitizer 134. Further, it is appreciated telemetry sub 128 can store detected and logged data for later retrieval at the surface when bottom hole assembly 150 is recovered.

Digitizer 134 converts the pressure pulses into a digital signal and sends the digital signal over a communication link to a computing system 137 or some other form of a data processing device. In at least some embodiments, computer system 137 includes processing units to analyze collected data and/or perform other operations by executing software or instructions obtained from a local or remote non-transitory computer-readable medium. As shown, computer system 137 includes input device(s) (e.g., a keyboard, mouse, touchpad, etc.) as well as output device(s) (e.g., monitors, printers, etc.). These input/output devices provide a user interface that enables an operator to interact and communicate with the borehole assembly 150, surface/downhole directional drilling components, and/or software executed by computer system 137.

For example, computer system 137 enables an operator to select or program directional drilling options, review or adjust types of data collected, modify values derived from the collected data (e.g., measured bit position, estimated bit position, bit force, bit force disturbance, rock mechanics, etc.), adjust borehole assembly dynamics model parameters, generate drilling status charts, waypoints, a desired borehole path, an estimated borehole path, and/or to perform other tasks. In at least some embodiments, the directional drilling performed by borehole assembly 150 is based on a surface and/or downhole feedback loops, as discussed in greater detail below.

MWD system 100 also includes a controller 152 that instructs or steers bottom hole assembly 150 as drill bit 114 extends wellbore 116 along a desired path 119 (e.g., within one or more boundaries 140). Controller 152 includes processors, sensors, and other hardware/software such as a rotary steerable system (RSS). In operation, controller 152 applies a force to flex or bend a drilling shaft coupled to bottom hole assembly 150 thereby imparting an angular deviation to a current the direction traversed by drill bit 114. Controller 152 can communicate real-time data with one or more components of bottom hole assembly 150 and/or surface equipment. In this fashion, controller 152 can analyze real-time data and generate steering signals according to, for example, the feedback control techniques discussed herein. While controller 152 is shown and described as a single component that operates for a particular type of directional drilling, it is appreciated controller 152 may include any number of sub-components that collectively communicate and operate to perform the above discussed functions. Controller 152 represents an example component, which may further include various other types of steering mechanisms as well—e.g., steering vanes, a bent sub, and the like. It is further appreciated by those skilled in the art, the environment shown in FIG. 1 is provided for purposes of discussion only, not for purposes of limitation. The detection tools, drilling devices, and sliding mode control techniques discussed herein may be suitable in any number of drilling environments.

It is further appreciated by those skilled in the art, the environment shown in FIG. 1 is provided for purposes of discussion only, not for purposes of limitation. The detection tools, drilling devices, and curvature-based feedback control techniques discussed herein may be suitable in any number of drilling environments.

Figure 2:
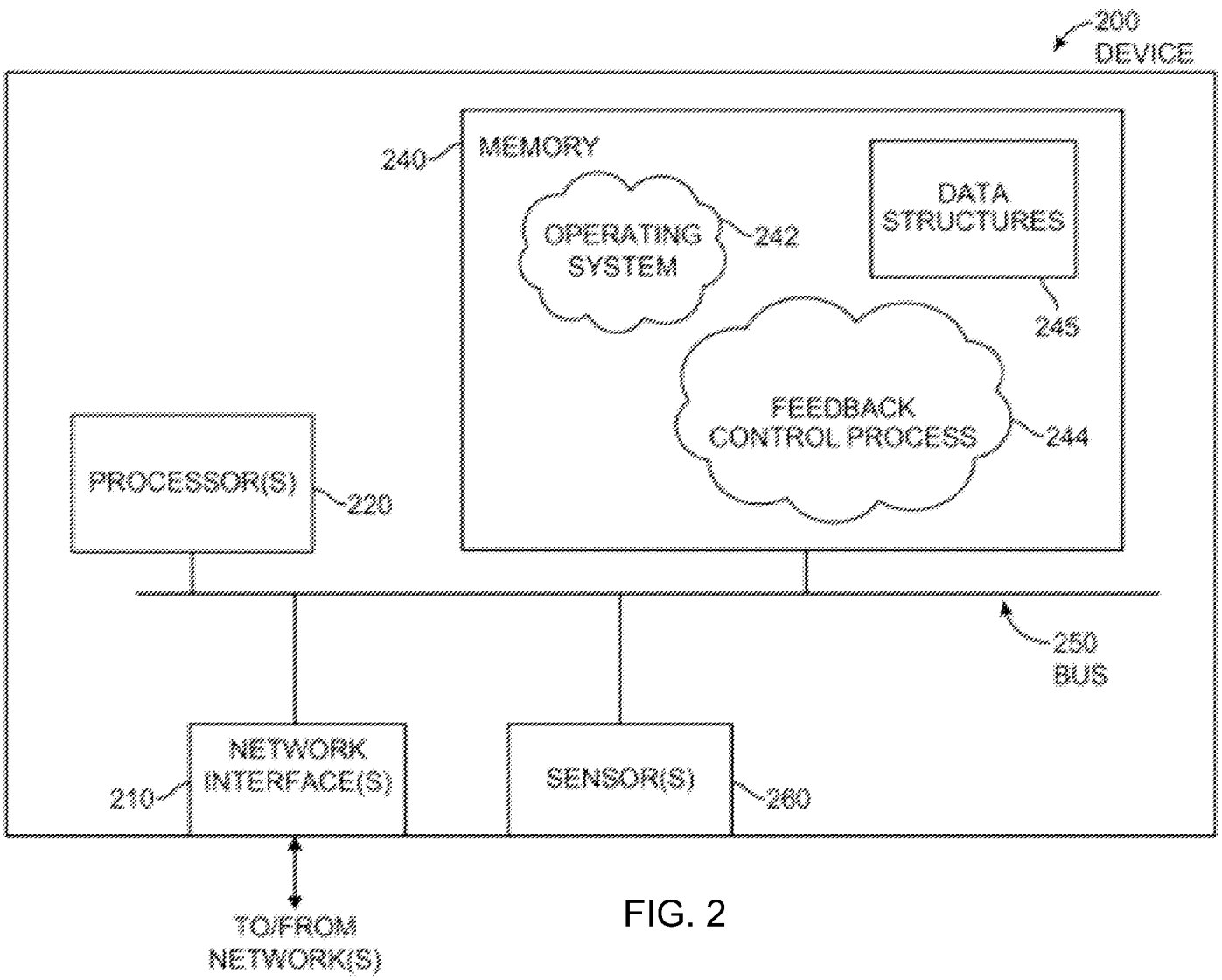
FIG. 2 is a block diagram of an example device for performing the presently disclosed control techniques, in accordance with aspects of the present disclosure.

FIG. 2 is a block diagram of an exemplary device 200, which can include controller 152 (or components thereof). Device 200 is configured to perform control techniques discussed herein and communicates signals that steer or direct the drilling tool along a well path. In operation, device 200 communicates with one or more of the above-discussed borehole assembly 150 components and may also be configured to communicate with remote devices/systems such as computer system 137.

As shown, device 200 includes hardware and software components such as network interfaces 210, at least one processor 220, sensors 260 and a memory 240 interconnected by a system bus 250. Network interface(s) 210 include mechanical, electrical, and signaling circuitry for communicating data over communications links, which may include wired or wireless communication links. Network interfaces 210 are configured to transmit and/or receive data using a variety of different communication protocols, as will be understood by those skilled in the art. For example, device 200 can use network interface 210 to communicate with one or more of the above-discussed borehole assembly 150 components and/or communicate with remote devices/systems such as computer system 137.

Processor 220 represents a digital signal processor (e.g., a microprocessor, a microcontroller, or a fixed-logic processor, etc.) configured to execute instructions or logic to perform tasks in a wellbore environment. Processor 220 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 220 typically operates in conjunction with shared or dedicated hardware, including but not limited to, hardware capable of executing software and hardware. For example, processor 220 may include elements or logic adapted to execute software programs and manipulate data structures 245, which may reside in memory 240.

Sensors 260 typically operate in conjunction with processor 220 to perform wellbore measurements, and can include special-purpose processors, detectors, transmitters, receivers, and the like. In this fashion, sensors 260 may include hardware/software for generating, transmitting, receiving, detecting, logging, and/or sampling magnetic fields, seismic activity, and/or acoustic waves.

Memory 240 comprises a plurality of storage locations that are addressable by processor 220 for storing software programs and data structures 245 associated with the embodiments described herein. An operating system 242, portions of which are typically resident in memory 240 and executed by processor 220, functionally organizes the device by, inter alia, invoking operations in support of software processes and/or services executing on device 200. These software processes and/or services may comprise an illustrative process/service 244, as described herein. Note that while process/service 244 is shown in centralized memory 240, some embodiments provide for these processes/services to be operated in a distributed computing network.

It will be apparent to those skilled in the art that other processor and memory types, including various computer-readable media, may be used to store and execute program instructions pertaining to the borehole evaluation techniques described herein. Also, while the description illustrates various processes, it is expressly contemplated that various processes may be embodied as modules configured to operate in accordance with the techniques herein (e.g., according to the functionality of a similar process). Further, while some processes or functions may be described separately, those skilled in the art will appreciate the processes and/or functions described herein may be performed as part of a single process. In addition, the disclosed processes and/or corresponding modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 220 or computer readable medium encoded with instructions for execution by processor 220 that, when executed by the processor, are operable to cause the processor to perform the functions described herein.

The example environment 100 shown in FIG. 1 and the example device 200 show in FIG. 2 can be implemented using the systems, methods, and techniques described herein. In particular, the disclosed system, methods, and techniques may directly or indirectly affect one or more components or pieces of equipment associated with the example rotary directional drilling system, according to one or more embodiments.

Drilling operations can be managed from a rig at ground level, where the main drilling parameters such as a hook load (e.g., axial tension force can be applied at the top of a drill string), rotary speed, and mud flow can be controlled. The drill string can include a long shaft composed of circular pipes, which can transmit torque and axial loads from the rig to a bit. Most of the drill string can be in tension to avoid buckling, but a compressive thrust may be required at the bit (also known as the so-called weight on bit). A lower portion of the drill string (e.g., a Bottom-Hole Assembly (BHA)) can also operate in compression. Directional drilling can provide the following applications: sidetracking to circumvent obstructions at the bottom of the hole; avoiding hard-to-drill geological formations such as a salt dome; drilling beneath inaccessible or difficult-to-access locations such as lakes or cities; drilling different wells from a same location for either offshore drilling or limited field disturbance; and drilling relief wells following emergencies such as blowouts.

Horizontal drilling is a direct extension of directional drilling. Directional drilling is also used in shale gas and oil exploitation for which compact, low-conductivity reservoirs are stimulated by fractures hydraulically initiated from a horizontal well in the shale layer.

The instrument for altering wellbore direction is a component of the BHA for directional drilling applications. These can generally be separated into two categories: rotary steerable systems and a mud motor. The mud motor is the most commonly used directional drilling tool and utilizes downhole drilling fluid pressure to rotate the bit. The mud motor also includes a bend near the bit. When the mud motor operates in sliding mode for drilling curved wellbores, the top drive angular position can be adjusted and then held such that the bend points the bit in a desired drilling direction. Once the desired wellbore direction is achieved, the mud motor operates in the rotating mode, in which the whole drill string, including the bent section, is rotated by the top drive such that the bent direction is uniformly distributed to avoid drilling towards any particular direction off the current wellbore central axis.

Figure 3:
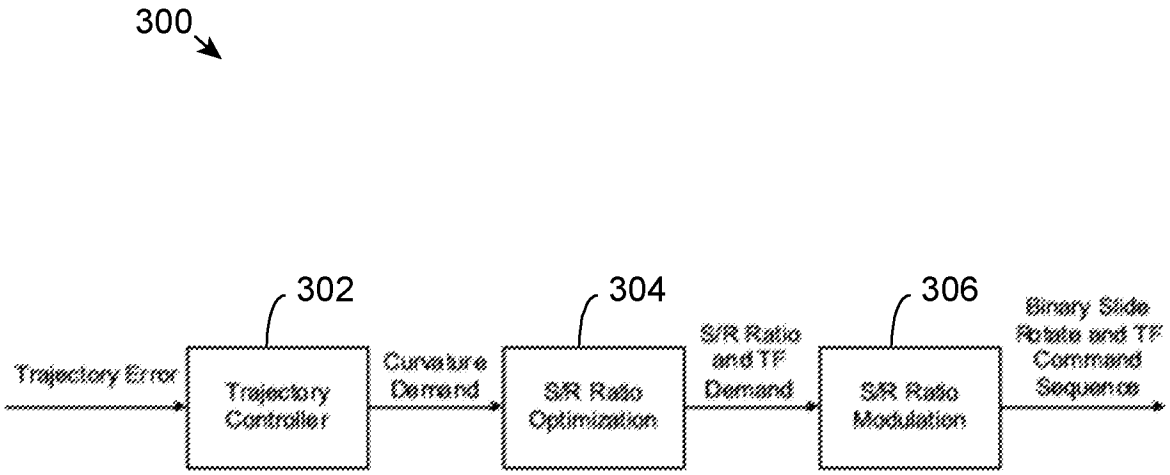
FIG. 3 illustrates an example block diagram 300 of a process of controlling mud motor trajectory, in accordance with aspects of the present disclosure.

FIG. 3 illustrates an example block diagram 300 of a process of controlling mud motor trajectory, in accordance with aspects of the present disclosure.

Directional drilling is to drill wells at multiple angles, not just vertically but also horizontally, to better reach and produce oil and gas reserves. A mud motor is a directional drilling tool used on oil/gas rig that can convert mud flow (e.g., hydraulic energy) into drilling bit rotations (e.g., mechanical energy). Directional drilling with mud motor can include two operation modes: slide mode and rotate mode. In slide mode, the bit can be rotating without drill string rotation that steers the borehole to a desired direction by utilizing the bend near the bit to direct the bit to a different direction from the wellbore axis. The mud motor can also provide mechanical power to rotate the bit in this mode. In the rotate mode, as the planed angle is achieved, the drill string can rotate to speed up drilling and continue drilling in the same direction.

During the directional drilling operation, a trajectory controller 302 can be used to regulate a borehole trajectory to be aligned with a well plan. As shown in FIG. 3, trajectory errors between the well plan and inclination and azimuth measurements can be inputs to the trajectory controller 302. The trajectory controller 302 can include an applicable controller, such as a model predictive controller, for controlling trajectory during drilling. The trajectory controller 302 can output a series of curvature demands such as build and walk rates (e.g., based on the inclination and azimuth measurements) over the next few hundred feet to drill. Based on curvature demands, a slide or rotate mode can be determined in an optimization module, e.g., Slide/Rotate (herein "S/R) Ratio Optimization module 304, as shown in FIG. 3.

Desired slide rotate ratios and toolface angles, as used herein, include slide rotate rations and toolface angles that are solved for using an applicable objective function, e.g. Equation 3, towards achieving a desired objective function. Specifically, desired slide rotate ratios and toolface angles can be achieved by solving an objective function with a solution that gives the minimum cost, e.g. an optimal or desired result. Desired slide rotate ratios and toolface angles can be achieved by solving an objective function that defines an objective according to either or both operational preferences and system constraints.

Operational preferences, as used herein, include applicable preferences for controlling operation of a mud motor according to the techniques described herein. System constraints, as used herein, include applicable constraints that restrict how a motor can be operated according to the techniques described herein. Either or both operational preferences and system constraints can be specific to a control mode. In turn, such operational preferences and system constraints can vary across different control modes.

The S/R Ratio and toolface demand can further be modulated by an S/R Ratio modulation module 306 to generate a binary slide-rotate control sequence, along with desired toolface angles, to command the mud motor to operate in the slide or rotate mode at different depths (e.g., range). Specifically, a S/R ratio modulation procedure can be generated and applied to create the control sequence. The control sequence can present Tie-to-Stand features and follow a choice of order of either a slide-then-rotate choice of order or a rotate-then-slide choice of order.

Considerations that may be taken when generating the desired S/R command sequence can include: (1) limiting the amount of switching between the slide and rotate modes; (2) providing flexibility that can follow operational preferences (e.g., allowing to slide for a long or a short length at a time based on the drilling inputs or the setting of the drilling control system); (3) satisfying slide-rotate distance constraints (e.g., after a slide, a minimum rotate length may be required before another slide is allowed); and (4) fulfilling recommended curvature demands generated by the trajectory controller 302, and thus, achieving the desired borehole trajectory as close as possible to the well plan.

Setting Up Finite Control Modes:

In some implementations, the process as described herein can include presenting a finite mode that can define a finite number of control modes including setting up a maximum number of slides allowed for a stand, or equivalently, the continuous slide length. For example, the process can include long/medium/short slide length options (i.e., three control modes) as shown in Table 1, which can be set to be respectively 1/2/3 times of the maximum number of a slide mode for a stand. Other examples can include having more or less than three control modes that can be assigned or designed. In some examples, a control horizon can be a control step in which the control actions remain the same and its length can be configured as one of the parameters for the trajectory controller 302.

TABLE 1

Mud Motor Slide/Rotate Control Modes

| OPTION A Max Continuous Slide Length | OPTION B Max Number of Slides Allowed for a Stand | Descriptions Min/Max Slide (S) and Min Rotate (R) Length and Control Horizon [ft] |
|---|---|---|
| Short | 3 | Min/Max S. = 10/20<br>Min R. = 10<br>CtlHrzn = 30 (CtlHrzn = Max S. + Min R.) |

TABLE 1-continued

Mud Motor Slide/Rotate Control Modes

| OPTION A Max Continuous Slide Length | OPTION B Max Number of Slides Allowed for a Stand | Descriptions Min/Max Slide (S) and Min Rotate (R) Length and Control Horizon [ft] |
|---|---|---|
| Medium | 2 | Min/Max S. = 10/40<br>Min R. = 10<br>CtlHrzn = 50 (CtlHrzn = Max S. + Min R.) |
| Long | 1 | MaxSlide = 80 or no limit |

Deriving Slide Rotate Ratios and Toolface Angles:

Referring to FIG. 3, the S/R ratio optimization module 304 can generate an S/R ratio based on desired curvature demands from the trajectory controller 302. In some implementations, the process can include the following steps:

First, the process can include collecting curvature demands generated by the trajectory controller. The trajectory controller 302 can act after a survey is taken or can be enabled at any point by drilling personnel to generate the desired curvature demands. The curvature demands can be piecewise constants whose values may change for every control horizon (e.g., a constant footage can be pre-specified as shown in Table 1). The desired curvature demands can also be used as reference points for further calculations (e.g., $K_{inc\text{-}ref}$ for build rate and $K_{pazi\text{-}ref}$ for turn rate).

Second, the process can include establishing an objective function to determine slide-rotate ratios and toolface angles to satisfy the curvature demands. Estimated build rates and turn rates can be calculated using equation (1) that can be a nonlinear or linear function of slide and rotate tool yields, steering inputs, and slide rotate ratios:

$$\dot{\theta}=f(K_{slide},K_{rotate},u,S) \tag{1}$$

A linear function of Equation (1) is shown below:

$$\dot{\theta}=K_{slide}\cdot u\cdot S+K_{rotate}\cdot(1-S), \tag{2}$$

$\dot{\theta}$ can refer to a build rate or turn rate. $K_{slide}$ can refer to a sliding tool yield in an inclination or azimuth plane. $K_{rotate}$ can refer to a rotating tool yield in the inclination or azimuth plane. u can refer to a steering input that is equal to cos(toolface_angle) for a build rate and sin(toolface_angle) for a turn rate. S can refer to a slide-rotate ratio.

An objective function can be established with Equation 3 below:

$$0)\cdot)=\alpha_1|K_{inc\text{-}ref}-K_{inc\text{-}est}|^n+\alpha_2|K_{pazi\text{-}ref}-K_{pazi\text{-}est}|^n+\beta_1|S|^n+\beta_2|\text{lim } 1-S|^n, \tag{3}$$

where $\alpha_1\alpha_2>0$ are weighting factors, factor $\beta_1\geq 0$ is set to penalize a long slide, $\beta_2\leq 0$ to penalize frequent short slides, and n=1, 2. lim 1 can refer to the ratio of minimum slide distance over a length of a control horizon. lim 2 can refer to the ratio of maximum slide distance over the control horizon.

Equation (3) can also utilize a grid search to generate a series of slide-rotate ratios (e.g., S), and tool face values (e.g., TF) to fulfill the desired curvature demands. $\beta_1$ and $\beta_2$ of Equation (3) can also be utilized to prevent very long slides and large amounts of short slides. When lim 1 lim 2 of Equation (3) are utilized, the constraints of minimum/maximum continuous slide lengths and minimum rotate slide lengths can be achieved. Table 2, as shown below, further illustrates the above-mentioned parameters and process.

Modulating S/R Ratio:

In some implementations, slide-rotate ratios can be generated as decimal values between 0 and 1. For example, the slide-rotate ratios can be utilized to command the mud motor to operate in a slide mode or a rotate mode. The slide-rotate ratio values can then be modulated to a sequence of zeros and ones.

In some examples, the process as described herein can include utilizing a Tie-to-Stand process. The Tie-to-Stand process can include a stand (e.g., a unit) having a length around 90 feet, which can be considered a unit. At the start of a stand, a new command sequence can be issued. During the Tie-to-Stand process, the slide-rotate ratios may be adjusted to a new set of slide-rotate ratios to align with the stand. For example, a pair of slide lengths (e.g., control horizon times slide ratio) and the associated toolface angle can be considered a vector (e.g., a scalar with direction), a slide length can be a magnitude value, and a toolface angle can represent the direction. By applying vector additions, the process can include new vectors with new pairs of slide lengths and angles that can align the slide-rotate command sequence with the stand.

Figure 4A:
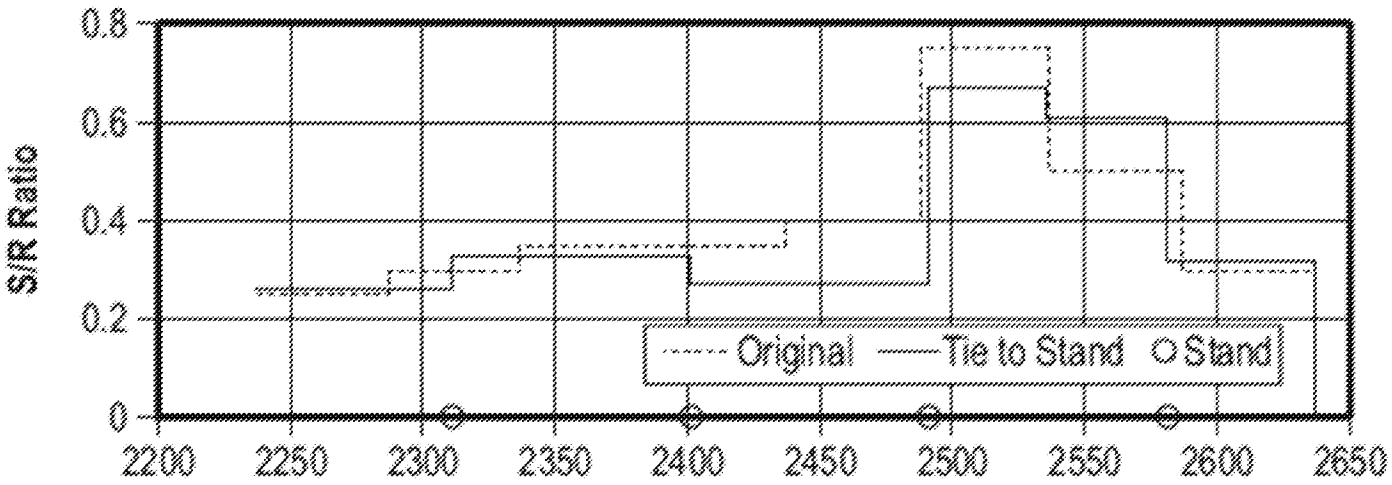
FIG. 4A illustrates a graph of S/R ratio as a function of bit depth that is generated after applying the tie-to-stand process at a specific control mode, in accordance with aspects of the present disclosure.
Figure 4B:
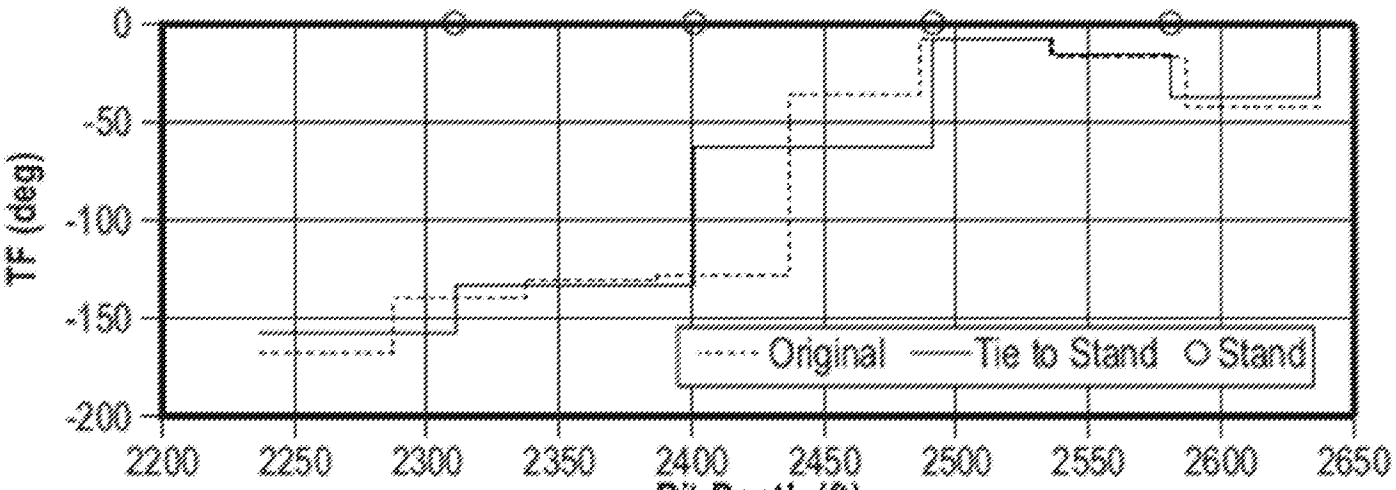
FIG. 4B illustrates a graph of toolface angle as a function of bit depth that is generated after applying the tie-to-stand process at a specific control mode, in accordance with aspects of the present disclosure.
Figure 5:
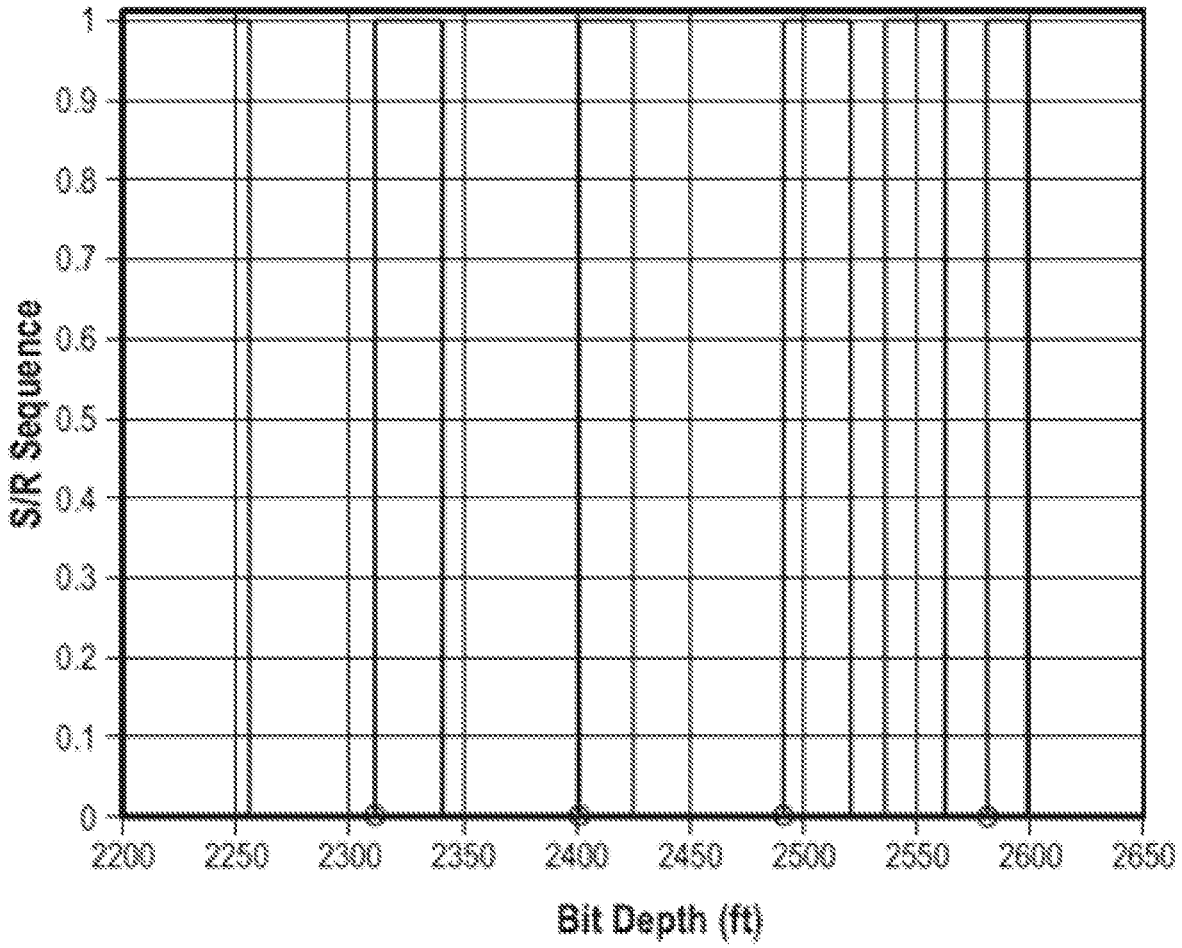
FIG. 5 illustrates an example graph of a slide-rotate command sequence as a functions of bit depth that is generated with a specific control mode of "Medium," in accordance with aspects of the present disclosure.

FIG. 4A illustrates a graph of S/R ratio as a function of bit depth that is generated after applying the Tie-to-Stand process at a specific control mode, in accordance with aspects of the present disclosure. FIG. 4B illustrates a graph of toolface angle as a function of bit depth that is generated after applying the Tie-to-Stand process at a specific control mode, in accordance with aspects of the present disclosure. FIG. 5 illustrates an example graph of a slide-rotate command sequence as a functions of bit depth—that is generated with a specific control mode of "Medium," in accordance with aspects of the present disclosure.

In some implementations, the process as described herein can include utilizing "Slide-Then-Rotate" or "Rotate-Then-Slide" logic. Under certain circumstances, it may be more beneficial for the trajectory control performance to apply the slide portion first (e.g., to adjust for the desired orientation) and then to rotate, or to apply the rotate portion first (e.g., to generate clearance in the borehole) and then to slide. FIG. 4A, FIG. 4B, and FIG. 5 illustrate examples of utilizing a Medium Control Mode, where the control horizon is set to 50 feet for the next 400 feet. Specifically, FIGS. 4A and 4B illustrate an example of Tie-to-Stand adjustment of slide-rotate ratios and toolface angles. FIG. 5 illustrates an example of a resulting binary slide-rotate command sequence.

TABLE 2

Pseudo code for a procedure to derive slide rotate ratios and toolface angles

```
Step 1: Obtain the curvature demands Kinc_ref and Kpazi_ref for each control horizon to become
reference points also denoted here as Tref(1:k) and Pref(1:k) where there are k control horizons.
Step 2: Establish cost function Equation (3) for finding the best slide ratios and toolface angles for each
horizon.
Step 3: Assign the range of slide ratio to be within MinSldDist/CtrlHrzn (lim1) and MaxSldDist/CtrlHrzn
(lim2) plus 0,0. Then do the following calculations:
deltaT := 0; %compensation term for Kinc reference points
deltaP := 0; %compensation term for Kpazi reference points
FOR i = 1:1:k
  FOR each s = {0, [lim1:0,01:lim2]} AND each tf = [0:1:359]; %grid search
    Calculate t_est, p_rest with s and tf; %estimated Kinc and Kpazi
    Calculate O(t_res - Tref(i), p_res-Pref(i), s)
  END_FOR
  % from the min cost result to get corresponding SR, TF and T_est and P_est
  [S(i), TF(i), Test(i), Pest(i)] = argmin(O(.));
  %generate compensated reference point values
  IF (S(i) == 0 OR lim1 OR lim2) AND i < k THEN
    deltaT := Tref(i) - Test(i) + deltaT;
    deltaP := Pref(i) - Pest(i) + deltaP;
    Tref(i+1) := Tref(i+1) + deltaT;
    Pref(i+1) := Pref(i+1) + deltaP;
    Tref(i+1) := Limit(Kinc_lb, Kinc_ub);%apply lower&upper bounds for reference values
    Pref(i+1) := Limit(Kazi_lb, Kazi_ub);
  END_IF
END_FOR
Step 4: Send S(1:k) and TF(1:k) to Modulation module.
```

Simulation:

Simulation tests can be conducted to verify and validate the process as described herein (e.g., in real time).

Figure 6A:
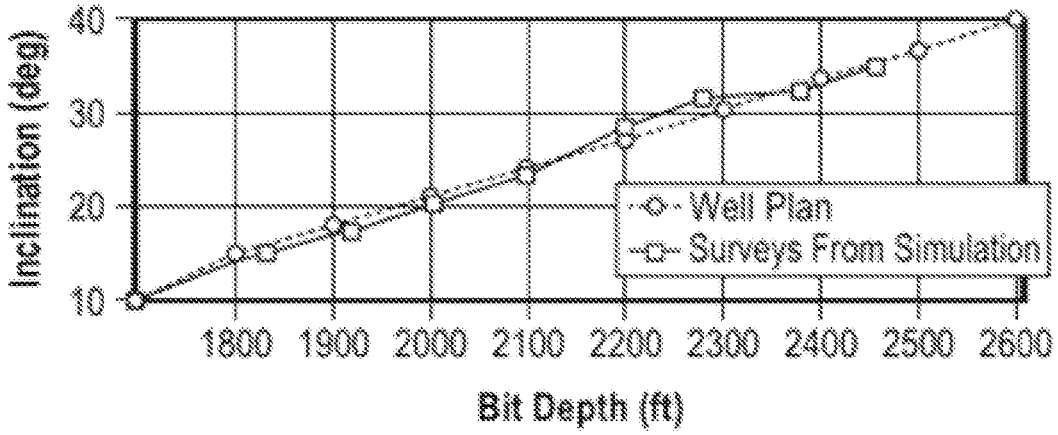
FIG. 6A illustrates a graph of inclination for a well plan and a simulated survey as a function of bit depth that is generated through a short control mode, in accordance with aspects of the present disclosure.
Figure 6B:
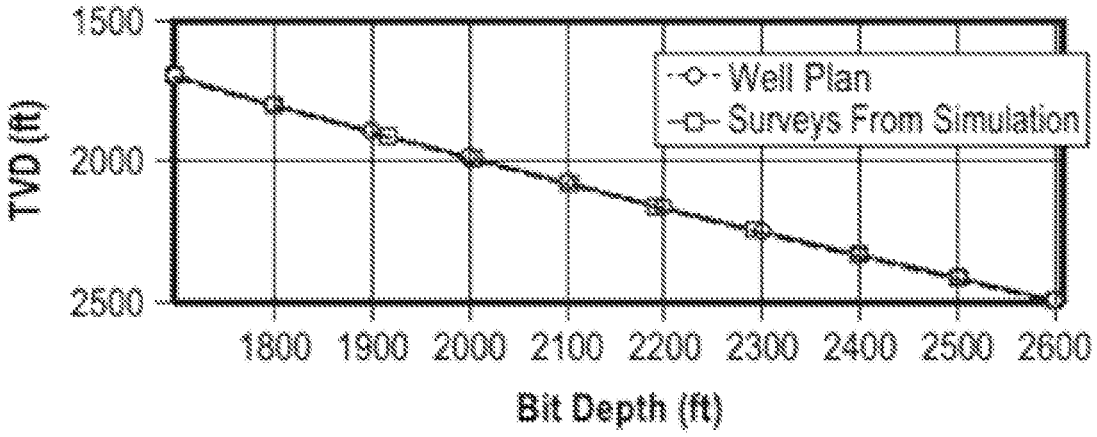
FIG. 6B illustrates a graph of true vertical depth (herein "TVD") for a well plan and a simulated survey as a function of bit depth that is generated through a short control mode, in accordance with aspects of the present disclosure.
Figure 6C:
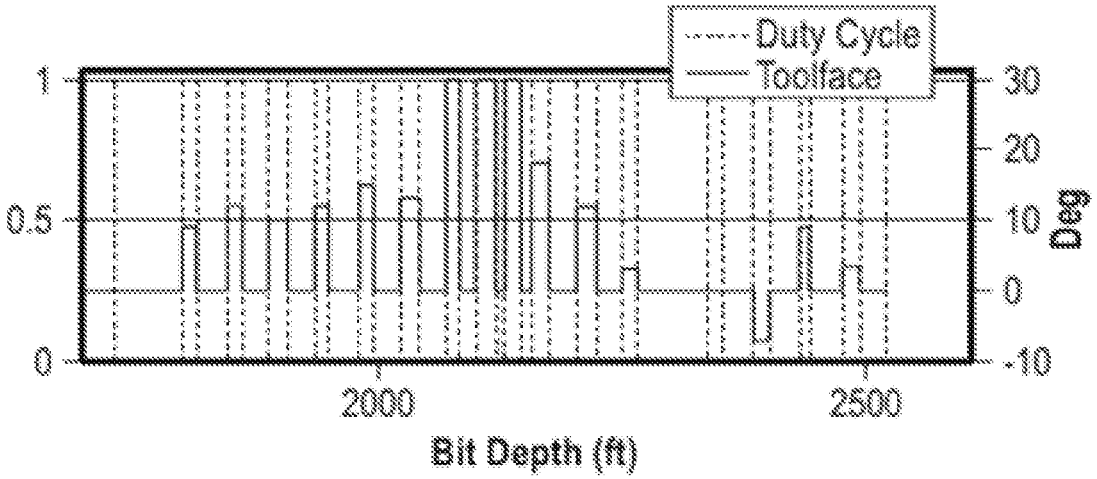
FIG. 6C illustrates a graph of duty cycle and toolface as a function of bit depth that is generated through a short control mode, in accordance with aspects of the present disclosure.
Figure 6D:
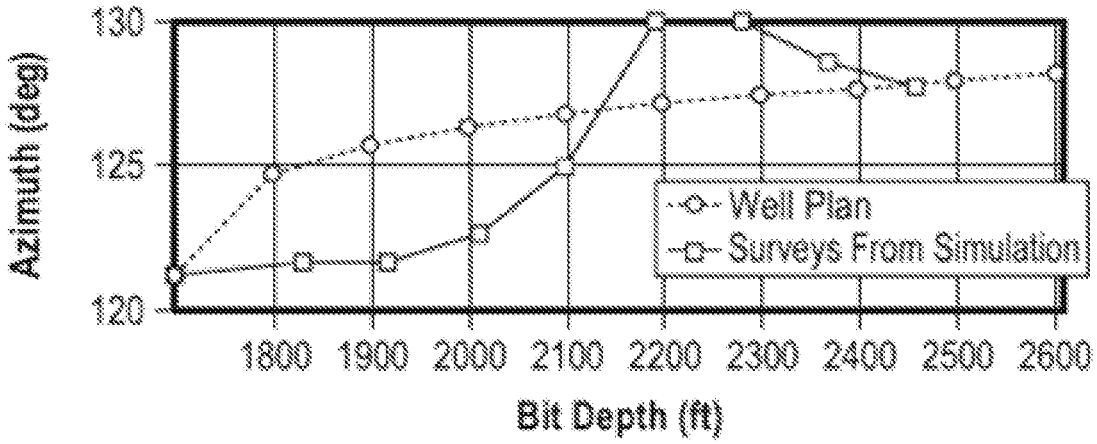
FIG. 6D illustrates a graph of Azimuth for a well plan and a simulated survey as a function of bit depth that is generated through a short control mode, in accordance with aspects of the present disclosure.
Figure 6E:
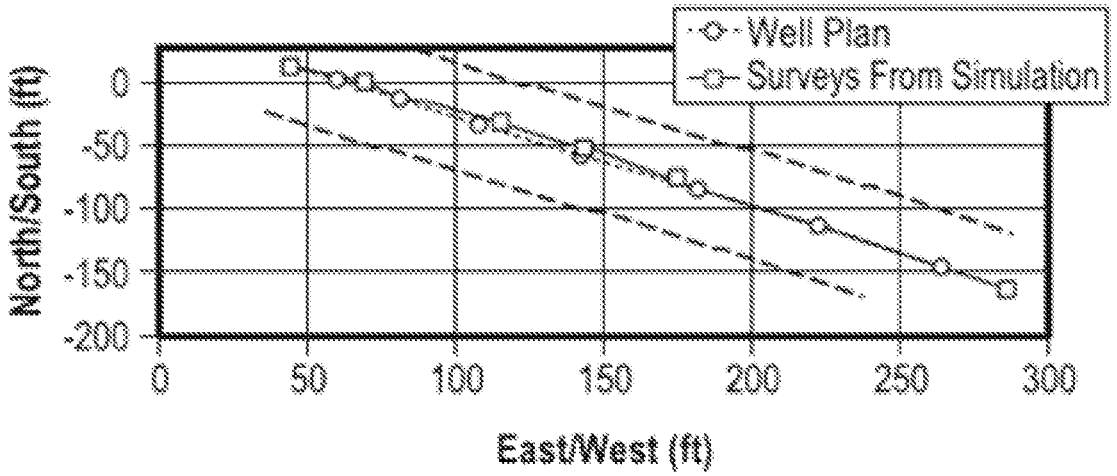
FIG. 6E illustrates a graph of north/south and east/west position across a control horizon that is generated through a short control mode, in accordance with aspects of the present disclosure.

FIGS. 6A-E illustrate example graphs of trajectories with a control mode of "Short," in accordance with aspects of the present disclosure. Specifically, FIG. 6A illustrates a graph of inclination for a well plan and a simulated survey as a function of bit depth that is generated through a short control mode, in accordance with aspects of the present disclosure. FIG. 6B illustrates a graph of true vertical depth (herein "TVD") for a well plan and a simulated survey as a function of bit depth that is generated through a short control mode, in accordance with aspects of the present disclosure. FIG. 6C illustrates a graph of duty cycle and toolface as a function of bit depth that is generated through a short control mode, in accordance with aspects of the present disclosure. FIG. 6D illustrates a graph of Azimuth for a well plan and a simulated survey as a function of bit depth that is generated through a short control mode, in accordance with aspects of the present disclosure. FIG. 6E illustrates a graph of north/south and east/west position across a control horizon that is generated through a short control mode, in accordance with aspects of the present disclosure.

Figure 7A:
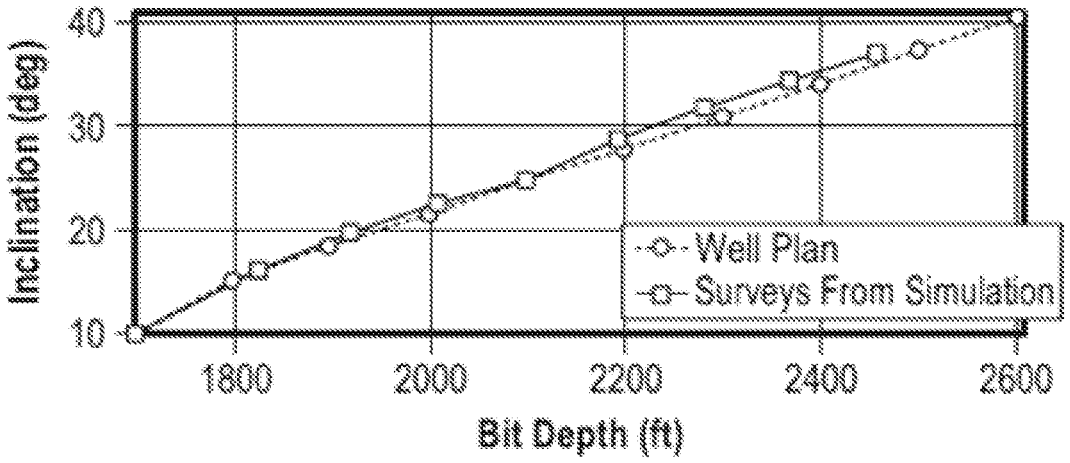
FIG. 7A illustrates a graph of inclination for a well plan and a simulated survey as a function of bit depth that is generated through a long control mode, in accordance with aspects of the present disclosure.
Figure 7B:
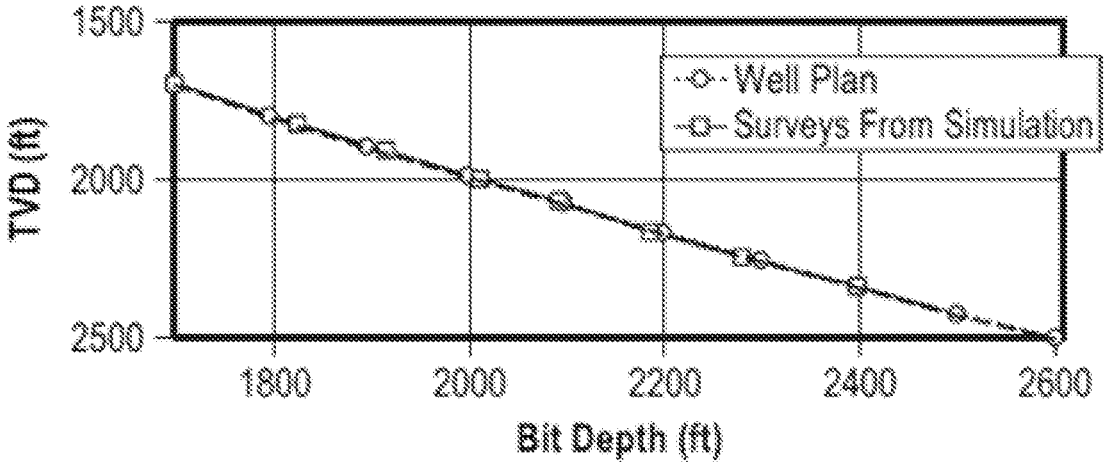
FIG. 7B illustrates a graph of true vertical depth (herein "TVD") for a well plan and a simulated survey as a function of bit depth that is generated through a long control mode, in accordance with aspects of the present disclosure.
Figure 7C:
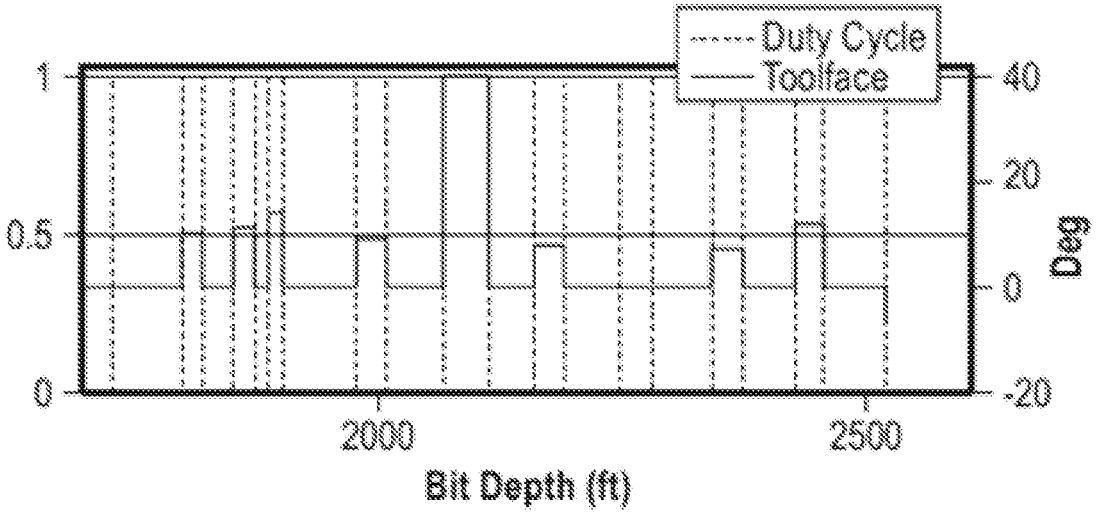
FIG. 7C illustrates a graph of duty cycle and toolface as a function of bit depth that is generated through a long control mode, in accordance with aspects of the present disclosure.
Figure 7D:
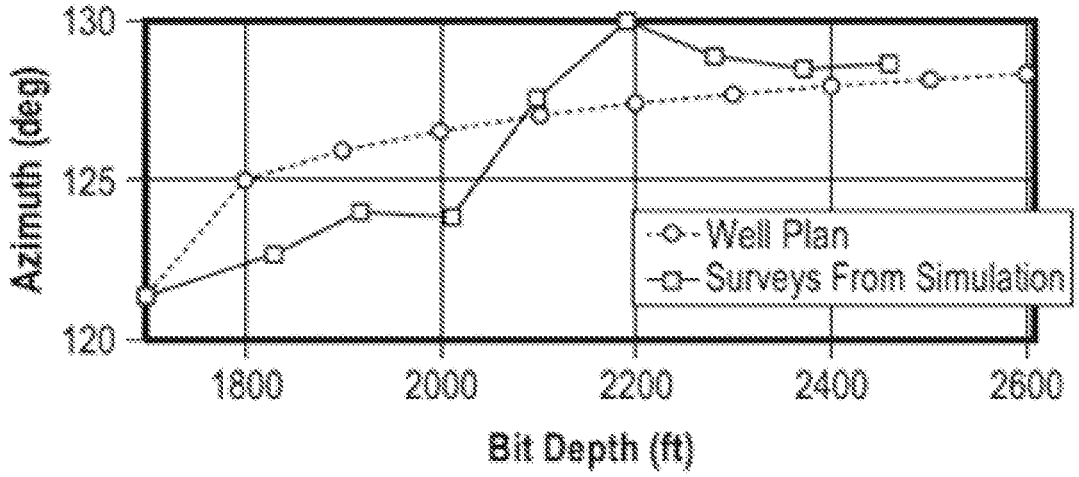
FIG. 7D illustrates a graph of Azimuth for a well plan and a simulated survey as a function of bit depth that is generated through a long control mode, in accordance with aspects of the present disclosure.
Figure 7E:
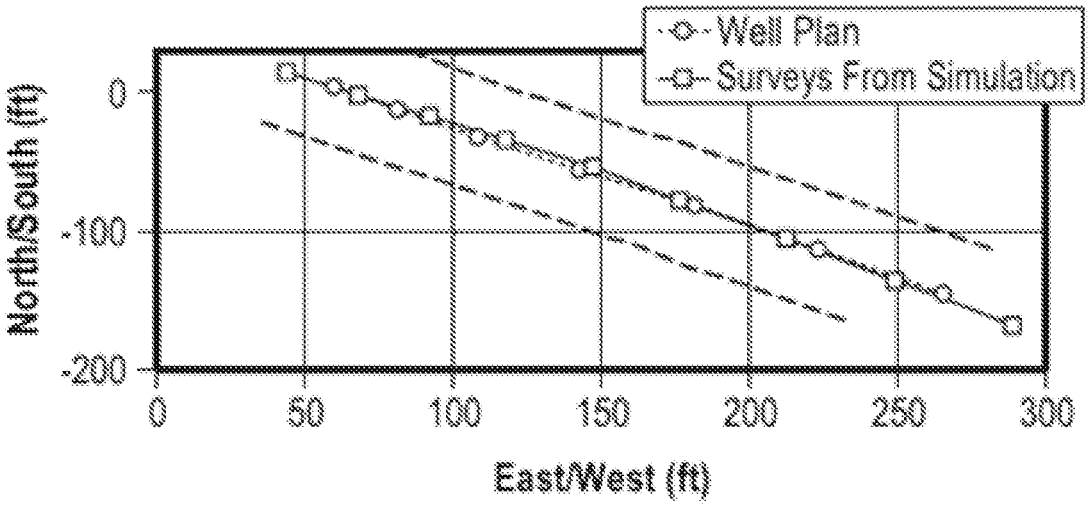
FIG. 7E illustrates a graph of north/south and east/west position across a control horizon that is generated through a long control mode, in accordance with aspects of the present disclosure.

FIGS. 7A-E illustrate example graphs of trajectories with a control mode of "Long," in accordance with aspects of the present disclosure. Specifically, FIG. 7A illustrates a graph of inclination for a well plan and a simulated survey as a function of bit depth that is generated through a long control mode, in accordance with aspects of the present disclosure. FIG. 7B illustrates a graph of true vertical depth (herein "TVD") for a well plan and a simulated survey as a function of bit depth that is generated through a long control mode, in accordance with aspects of the present disclosure. FIG. 7C illustrates a graph of duty cycle and toolface as a function of bit depth that is generated through a long control mode, in accordance with aspects of the present disclosure. FIG. 7D illustrates a graph of Azimuth for a well plan and a simulated survey as a function of bit depth that is generated through a long control mode, in accordance with aspects of the present disclosure. FIG. 7E illustrates a graph of north/south and east/west position across a control horizon that is generated through a long control mode, in accordance with aspects of the present disclosure.

As shown in the graphs of FIGS. 6A-E and 7A-E The trajectory controller 302 can provide curvature demands with 30 feet as a control horizon for the upcoming 300 feet. Further, the variables are well controlled under either mode to remain close to the well plan. In addition, similarities in the graphs of FIGS. 6A-E and 7A-E, which also can demonstrate the consistency of the process as described herein on deriving the slide-rotate ratios and their subsequent modulations for binary command sequences across different modes.

In other implementations, the number of finite control modes can be any integer number suitable for the intended purpose and understood by a person of ordinary skill in the art. In other examples, the grid search process as described in Table 2 can be used to determine the solution of Equation (3). Other advanced search or optimization algorithms that can also be applied to solve Equation (3). In some implementations, additional constraints or terms can also be utilized when deriving the slide-rotate ratios and/or modulating slide-rotate ratios, if needed or requested by drilling personnel under certain situations.

Figure 8:
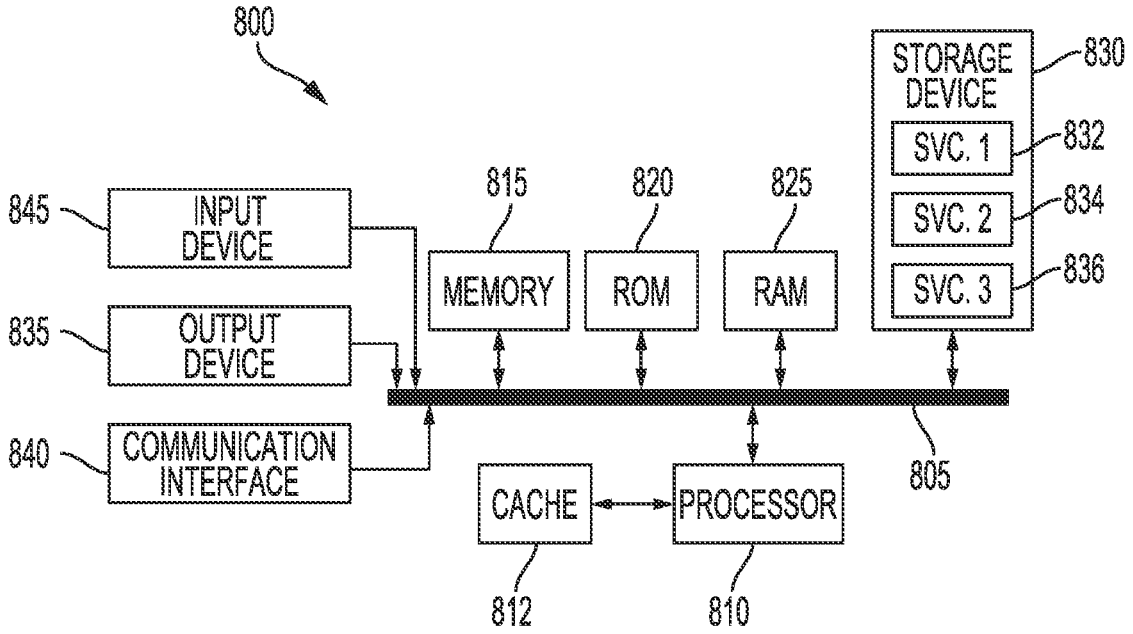
FIG. 8 illustrates an example computing device architecture that can be employed to perform various steps, methods, and techniques disclosed herein.

FIG. 8 illustrates an example computing device architecture 800, which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 8 illustrates an example computing device architecture 800 of a computing device, which can implement the various technologies and techniques described herein. The components of the computing device architecture 800 are shown in electrical communication with each other using a connection 805, such as a bus. The example computing device architecture 800 includes a processing unit (CPU or processor) 810 and a computing device connection 805 that couples various computing device components including the computing device memory 815, such as read only memory (ROM) 820 and random access memory (RAM) 825, to the processor 810.

The computing device architecture 800 can include a cache of high-speed memory connected directly with, in close proximity to, or integrated as part of the processor 810. The computing device architecture 800 can copy data from the memory 815 and/or the storage device 830 to the cache 812 for quick access by the processor 810. In this way, the cache can provide a performance boost that avoids processor 810 delays while waiting for data. These and other modules can control or be configured to control the processor 810 to perform various actions. Other computing device memory 815 may be available for use as well. The memory 815 can include multiple different types of memory with different performance characteristics. The processor 810 can include any general purpose processor and a hardware or software service, such as service 1 832, service 2 834, and service 3 836 stored in storage device 830, configured to control the processor 810 as well as a special-purpose processor where software instructions are incorporated into the processor design. The processor 810 may be a self-contained system, containing multiple cores or processors, a bus, memory controller, cache, etc. A multi-core processor may be symmetric or asymmetric.

To enable user interaction with the computing device architecture 800, an input device 845 can represent any number of input mechanisms, such as a microphone for speech, a touch-sensitive screen for gesture or grail input, keyboard, mouse, motion input, speech and so forth. An output device 835 can also be one or more of a number of output mechanisms known to those of skill in the art, such as a display, projector, television, speaker device, etc. In some instances, multimodal computing devices can enable a user to provide multiple types of input to communicate with the computing device architecture 800. The communications interface 840 can generally govern and manage the user input and computing device output. There is no restriction on operating on any particular hardware arrangement and therefore the basic features here may easily be substituted for improved hardware or firmware arrangements as they are developed.

Storage device 830 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 825, read only memory (ROM) 820, and hybrids thereof. The storage device 830 can include services 832, 834, 836 for controlling the processor 810. Other hardware or software modules are contemplated. The storage device 830 can be connected to the computing device connection 805. In one aspect, a hardware module that performs a particular function can include the software component stored in a computer-readable medium in connection with the necessary hardware components, such as the processor 810, connection 805, output device 835, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data, which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A method comprising: receiving control data from a mud motor trajectory controller; predefining a plurality of control modes based on the control data from the mud motor trajectory controller; achieving desired slide rotate ratios and toolface angles by solving an established objective function that mathematically represents operational preferences and system constraints for a selected control mode of the plurality of control modes; generating a modulation procedure that converts the slide-rotate ratios to a binary slide and rotate control sequence; and applying the modulation procedure to generate the binary slide and rotate control sequence.

Statement 2: The method of Statement 1, wherein the mud motor trajectory controller is a model predictive control system.

Statement 3: The method of any of Statements 1 to 2, wherein the control data includes curvature demands for subsequent drilling operations.

Statement 4: The method of any of Statements 1 to 3, wherein the plurality of control modes includes a plurality of settings having respective continuous slide and rotate lengths.

Statement 5: The method of any of Statements 1 to 4, further comprising providing the modulation procedure to at least one of advisory display and an automatic closed loop trajectory control system.

Statement 6: The method of any of Statements 1 to 5, wherein the plurality of control modes is a finite number of control modes.

Statement 7: The method of any of Statements 1 to 6, wherein the finite number of control modes includes a short mode, a medium mode, and a long mode.

Statement 8: The method of any of Statements 1 to 7, wherein the binary slide and rotate control sequence presents the Tie-to-Stand features and follows a choice of order that is either slide-then-rotate or rotate-then-slide.

Statement 9: A system comprising: one or more processors; and a computer-readable medium comprising instructions stored therein, which when executed by the one or more processors, cause the one or more processors to: receive control data from a mud motor trajectory controller; predefine a plurality of control modes based on the control data from the mud motor trajectory controller; achieve desired slide rotate ratios and toolface angles by solving an established objective function that mathematically represents operational preferences and system constraints for a selected control mode of the plurality of control modes; generate a modulation procedure that converts the slide-rotate ratios to a binary slide and rotate control sequence; and apply the modulation procedure to generate the binary slide and rotate control sequence.

Statement 10: The system of Statement 9, wherein the mud motor trajectory controller is a model predictive control system.

Statement 11: The system of any of Statements 9 to 10, wherein the control data includes curvature demands for subsequent drilling operations.

Statement 12: The system of any of Statements 9 to 11, wherein the plurality of control modes includes a plurality of settings having respective continuous slide and rotate lengths.

Statement 13: The system of any of Statements 9 to 12, wherein the instructions are further configured to cause the one or more processors to provide the modulation procedure to at least one of advisory display and an automatic closed loop trajectory control system.

Statement 14: The system of any of Statements 9 to 13, wherein the plurality of control modes is a finite number of control modes.

Statement 15: The system of any of Statements 9 to 14, wherein the finite number of control modes includes a short mode, a medium mode, and a long mode.

Statement 16: The system of any of Statements 9 to 15, wherein the binary slide and rotate control sequence presents the Tie-to-Stand features and follows a choice of order that is either slide-then-rotate or rotate-then-slide.

Statement 17: A non-transitory computer-readable storage medium comprising instructions stored therein, which when executed by one or more processors, cause the one or more processors to: receive control data from a mud motor trajectory controller; predefine a plurality of control modes based on the control data from the mud motor trajectory controller; achieve desired slide rotate ratios and toolface angles by solving an established objective function that mathematically represents operational preferences and system constraints for a selected control mode of the plurality of control modes; generate a modulation procedure that converts the slide-rotate ratios to a binary slide and rotate control sequence; and apply the modulation procedure to generate the binary slide and rotate control sequence.

Statement 18: The non-transitory computer-readable storage medium of Statement 17, wherein the mud motor trajectory controller is a model predictive control system.

Statement 19: The non-transitory computer-readable storage medium of any of Statements 17 to 18, wherein the control data includes curvature demands for subsequent drilling operations.

Statement 20: The non-transitory computer-readable storage medium of any of Statements 17 to 19, wherein the plurality of control modes includes a plurality of settings having respective continuous slide and rotate lengths.

Statement 21: The non-transitory computer-readable storage medium of any of Statements 17 to 20, wherein the instructions are further configured to cause the one or more processors to provide the modulation procedure to at least one of advisory display and an automatic closed loop trajectory control system.

Statement 22: The non-transitory computer-readable storage medium of any of Statements 17 to 21, wherein the plurality of control modes is a finite number of control modes.

Statement 23: The non-transitory computer-readable storage medium of any of Statements 17 to 22, wherein the finite number of control modes includes a short mode, a medium mode, and a long mode.

Statement 24: The non-transitory computer-readable storage medium of any of Statements 17 to 23, wherein the binary slide and rotate control sequence presents the Tie-to-Stand features and follows a choice of order that is either slide-then-rotate or rotate-then-slide.

What is claimed is:

1. A method comprising:

receiving control data that identifies curvature demands of a wellbore from a mud motor trajectory controller, wherein a plurality of predefined control modes are associated with the control data received from the mud motor trajectory controller;

identifying slide-rotate ratios and toolface angles by solving an established objective function that represents operational preferences and system constraints for a selected control mode of the plurality of control modes, wherein the operational preferences and the system constraints for the selected control mode identify:

a maximum number of slides per stand, a maximum or minimum continuous slide length per stand, and a minimum rotate length per stand;

generating a modulation procedure that converts the slide-rotate ratios to a binary slide and rotate control sequence constrained by the maximum number of slides per stand, the maximum or minimum continuous slide length per stand, and the minimum rotate length per stand;

applying the modulation procedure to generate the binary slide and rotate control sequence; and controlling drilling of the wellbore according to the selected control mode based on the binary slide and rotate control sequence of the modulation procedure.

2. The method of claim 1, wherein the mud motor trajectory controller is a model predictive control system.

3. The method of claim 1, wherein the control data includes curvature demands for subsequent drilling operations.

4. The method of claim 1, wherein the plurality of control modes includes a plurality of settings having respective continuous slide and rotate lengths.

5. The method of claim 1, further comprising providing the modulation procedure to at least one of advisory display and an automatic closed loop trajectory control system.

6. The method of claim 1, wherein the plurality of control modes is a finite number of control modes and the operational preferences and the system constraints for the selected control mode also identify a maximum slide-rotate switch time per stand.

7. The method of claim 6, wherein the finite number of control modes includes a short mode, a medium mode, and a long mode each constrained by a respective number of slides per stand setting.

8. The method of claim 1, wherein the binary slide and rotate control sequence presents Tie-to-Stand features and follows a choice of order that is either slide-then-rotate or rotate-then-slide.

9. A system comprising:

one or more processors; and a computer-readable medium comprising instructions stored therein, which when executed by the one or more processors, cause the one or more processors to:

receive control data that identifies curvature demands of a wellbore from a mud motor trajectory controller;

predefine a plurality of control modes based on the control data from the mud motor trajectory controller, wherein the plurality of predefined control modes are associated with the control data received from the mud motor trajectory controller;

identify desired slide-rotate ratios and toolface angles by solving an established objective function that represents operational preferences and system constraints for a selected control mode of the plurality of control modes, wherein the operational preferences and the system constraints for the selected control mode identify:

a maximum number of slides per stand, a maximum or minimum continuous slide length per stand, and a minimum rotate length per stand;

generate a modulation procedure that converts the slide-rotate ratios to a binary slide and rotate control sequence constrained by the maximum number of slides per stand, the maximum or minimum continuous slide length per stand, and the minimum rotate length per stand;

apply the modulation procedure to generate the binary slide and rotate control sequence, and control drilling of the wellbore according to the selected control mode based on the binary slide and rotate control sequence of the modulation procedure.

10. The system of claim 9, wherein the mud motor trajectory controller is a model predictive control system.

11. The system of claim 9, wherein the control data includes curvature demands for subsequent drilling operations.

12. The system of claim 9, wherein the plurality of control modes includes a plurality of settings having respective continuous slide and rotate lengths.

13. The system of claim 9, wherein the instructions are further configured to cause the one or more processors to provide the modulation procedure to at least one of advisory display and an automatic closed loop trajectory control system.

14. The system of claim 9, wherein the plurality of control modes is a finite number of control modes and the operational preferences and the system constraints for the selected control mode also identify a maximum slide-rotate switch time per stand.

15. The system of claim 14, wherein the finite number of control modes includes a short mode, a medium mode, and a long mode, each constrained by a respective number of slides per stand setting.

16. The system of claim 9, wherein the binary slide and rotate control sequence presents Tie-to-Stand features and follows a choice of order that is either slide-then-rotate or rotate-then-slide.

17. A non-transitory computer-readable storage medium comprising instructions stored therein, which when executed by one or more processors, cause the one or more processors to:

receive control data that identifies curvature demands of a wellbore from a mud motor trajectory controller;

predefine a plurality of control modes based on the control data from the mud motor trajectory controller, wherein the plurality of predefined control modes are associated with the control data received from the mud motor trajectory controller;

identify desired slide-rotate ratios and toolface angles by solving an established objective function that represents operational preferences and system constraints for a selected control mode of the plurality of control modes, wherein the operational preferences and the system constraints for the selected control mode identify:

a maximum number of slides per stand, a maximum or minimum continuous slide length per stand, and a minimum rotate length per stand;

generate a modulation procedure that converts the slide-rotate ratios to a binary slide and rotate control sequence constrained by the maximum number of slides per stand, the maximum or minimum continuous slide length per stand, and the minimum rotate length per stand;

apply the modulation procedure to generate the binary slide and rotate control sequence, and control drilling of the wellbore according to the selected control mode based on the binary slide and rotate control sequence of the modulation procedure.

18. The non-transitory computer-readable storage medium of claim 17, wherein the mud motor trajectory controller is a model predictive control system.

19. The non-transitory computer-readable storage medium of claim 17, wherein the control data includes curvature demands for subsequent drilling operations.

20. The non-transitory computer-readable storage medium of claim 17, wherein the plurality of control modes includes a plurality of settings having respective continuous slide and rotate lengths.

* * * * *